US005462037A

United States Patent [19]

Hasegawa et al.

[11] Patent Number: 5,462,037

[45] Date of Patent: Oct. 31, 1995

[54] A/F RATIO ESTIMATOR FOR MULTICYLINDER INTERNAL COMBUSTION ENGINE

[75] Inventors: Yusuke Hasegawa; Hidetaka Maki, both of Saitama, Japan

[73] Assignee: Honda Giken Kogyo Kabushiki Kaisha, Tokyo, Japan

[21] Appl. No.: 158,800

[22] Filed: Dec. 1, 1993

[30] Foreign Application Priority Data

Dec. 2, 1992 [JP] Japan ..... 4-349699

[51] Int. Cl.[6] ..... F02D 41/14

[52] U.S. Cl. ..... 123/673; 123/694

[58] Field of Search ..... 123/673, 694

[56] References Cited

U.S. PATENT DOCUMENTS 4,869,222 9/1989 Klassen ..... 123/673
4,962,741 10/1990 Cook et al. ..... 123/673

FOREIGN PATENT DOCUMENTS

0553570A2 8/1993 European Pat. Off. .
59-101562 6/1984 Japan .
60-88834 5/1985 Japan ..... 123/694

*Primary Examiner*—Andrew M. Dolinar
*Attorney, Agent, or Firm*—Nikaido, Marmelstein, Murray & Oram

[57] ABSTRACT

An air/fuel ratio estimator for estimating an air/fuel ratio of a mixture supplied to each cylinder of a multicylinder internal combustion engine through an output of an air/fuel ratio sensor installed at a confluence point of an exhaust system of the engine. The estimator includes first device for assuming the output of the air/fuel ratio sensor as an average value made up of a sum of products of past firing histories of each cylinder weighted by a predetermined value, and establishing a model using the air/fuel ratio as a state variable, a second device for obtaining a state equation with respect to the state variable. An observer is provided to estimate the unmeasured state variable indicative of the air/fuel ratio and the air/fuel ratio at each cylinder is estimated from an output of the observer. In the configuration upper and lower limit is established for the state variable such that it is replaced with its initial value if it exceeds either limit. As a result, a range of change of the variable is decreased so that the estimator can be realized on a low-performance microcomputer mounted on a vehicle.

12 Claims, 12 Drawing Sheets

42
CPU
50
ROM
52
RAM
54
Driver
68
Driver
66
Solenoid valve
70
Injector
20
A/D
48
A/D
60
Multiplexer
58
Counter
64
Detection circuit
46
Level converter
56
Pulse generator
62
Air/fuel ratio sensor
40
Throttle position sensor
36
Manifold absolute pressure sensor
38
Crank-angle sensor
34

A/F RATIO ESTIMATOR FOR MULTICYLINDER INTERNAL COMBUSTION ENGINE

BACKGROUND OF THE INVENTION

1. Field of the Invention

This invention relates to an air/fuel ratio estimator for a multicylinder internal combustion engine, more particularly to an air/fuel ratio estimator for a multicylinder internal combustion engine for estimating the air/fuel ratios at the individual cylinders from an output of a single air/fuel ratio sensor installed at a confluence point of an exhaust system, which can easily be realized on a microcomputer mounted on a vehicle.

2. Description of the Prior Art

It is a common practice to install a single air/fuel ratio sensor constituted as an oxygen concentration detector in the exhaust system of a multicylinder internal combustion engine, and feedback control the detected air/fuel ratio to a desired air/fuel ratio by regulating the amount of fuel supplied to the engine. A system of this type is taught by Japanese Laid-Open Patent Publication No. Sho 59(1984)-101,562, for example.

When a single air/fuel ratio sensor is thus installed at an confluence point (the exhaust manifold joint) of a multicylinder engine such as having four or six cylinders, the output of the sensor represents a mixture of the values at all cylinders. This makes it hard to obtain the actual air/fuel ratio at each cylinder, and thus makes it difficult to converge the actual air/fuel ratio to a desired air/fuel ratio properly. Although this can be solved by providing the sensor for the individual cylinders, the arrangement will necessarily be expensive and what is more, brings another problem on sensor's service life.

For that reason, the assignee proposed an air/fuel ratio estimator using an exhaust gas model (discrete state-variable model) which describes the behavior of exhaust gas in a multicylinder internal combustion engine provided with a single air/fuel ratio sensor at its confluence point of the exhaust system (Japanese Laid-Open Patent Publication Hei 5(1993)-180,044; also filed in the United States on Dec. 24, 1992 under the Ser. No. of 07/997,769, now abandoned). A state equation concerning state variables of the model indicating air/fuel ratios at the individual cylinders is defined, and an observer is designed to reconstruct an unmeasured state variable, such that the air/fuel ratios at the individual cylinders are estimated accurately.

When realizing such an estimator on a digital computer, it becomes necessary to define a range of changes and a least value for each variable, since the digital computer has a finite word length such as 4, 8, 16, or 32 bits. In general, the range of change is determined from a possible maximum value that the variable concerned can physically be, and the least value of the variable is determined by dividing the possible maximum value by the digital computer's word length. When there is a possibility that an input or a computation result of the variable could exceed the range of change thus determined, the range is enlarged such that no excess would occur, and the least value is newly calculated in the manner explained above.

Thus, the so-called observer estimates an unmeasured state variable such that an error between the state variables of a control system and of the observer converges to zero. In the course of estimation, however, the estimated value may temporarily be a value that could never be in a real world.

On the other hand, the resolving power in the estimation must be the same as the actual variable. Therefore, when implementing it on a low-performance, on-board microcomputer with fewer-word-length, there occurs an inconsistent problem that the resolving power of the variable becomes coarse if its range of change is made large, while the range becomes smaller if the resolution power is made fine. More specifically, when the variable's least significant bit (LSB) is assigned a small value so as to enhance accuracy, a possible maximum value of the variable is therefore limited to a certain extent, and hence the range of changes of the variable is automatically restricted.

SUMMARY OF THE INVENTION

An object of the invention is therefore to overcome the problem and to provide an air/fuel ratio estimator for a multicylinder internal combustion engine, which is enabled to be easily realized on a low-performance, microcomputer mounted on a vehicle.

For realizing the object, the present invention provides an air/fuel ratio estimator for estimating an air/fuel ratio of a mixture supplied to each cylinder of a multicylinder internal combustion engine through an output of an air/fuel ratio sensor installed at a confluence point of an exhaust system of the engine, including, estimating device for modeling the exhaust system by at least one state equation having a state variable indicative of the air/fuel ratio to estimate the air/fuel ratio of each cylinder of the engine. In the estimator a limiting device is provided for establishing a limit for the state variable such that the state variable is replaced with a value if the state variable exceeds the limit.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
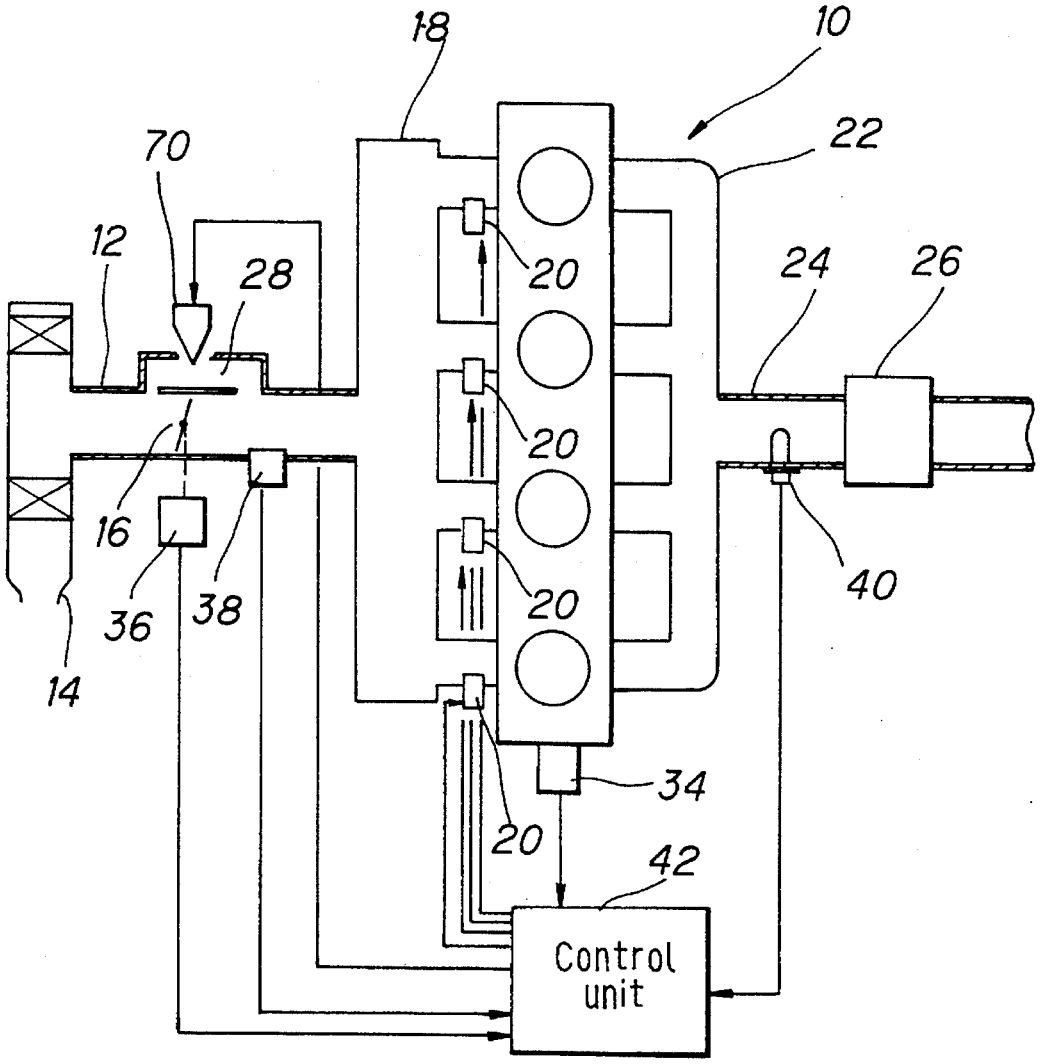
FIG. 1 is an overall schematic view of an air/fuel ratio control system for a four-cylinder internal combustion engine, in hardware construction, for implementing an air/fuel ratio estimator according to the present invention.

FIG. 1 is an overall schematic view of an air/fuel ratio control system for a four-cylinder internal combustion engine, which is the basis of an air/fuel ratio estimator according to the invention.

Reference numeral 10 in this figure designates an internal combustion engine having four cylinders. Air drawn in through an air cleaner 14 mounted on the far end of an air intake path 12 is supplied to the first through fourth cylinders through an air intake manifold 18 while the flow thereof is adjusted by a throttle valve 16. An injector 20 for injecting fuel is installed in the vicinity of the intake valve (not shown) of each cylinder. The injected fuel mixes. with the intake air to form an air-fuel mixture that is ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 22, from which it passes through an exhaust pipe 24 to a three-way catalytic converter 26, where it is removed of noxious components before being discharged to the exterior. In addition, the air intake path 12 is bypassed by a bypass 28 provided therein in the vicinity of the throttle valve 16.

A crank-angle sensor 34 for detecting the piston crank angles is provided in a distributor (not shown) of the internal combustion engine 10, a throttle position sensor 36 is provided for detecting the degree of opening of the throttle valve 16, and a manifold absolute pressure sensor 38 is provided for detecting the pressure of the intake air downstream of the throttle valve 16 as an absolute pressure. An air/fuel ratio sensor 40 constituted as an oxygen concentration detector is provided at the exhaust pipe 24 in the exhaust system at a point downstream of the exhaust manifold 22 and upstream of the three-way catalytic converter 26, where it detects the air/fuel ratio of the exhaust gas. The outputs of these sensors are sent to a control unit 42.

Figure 2:
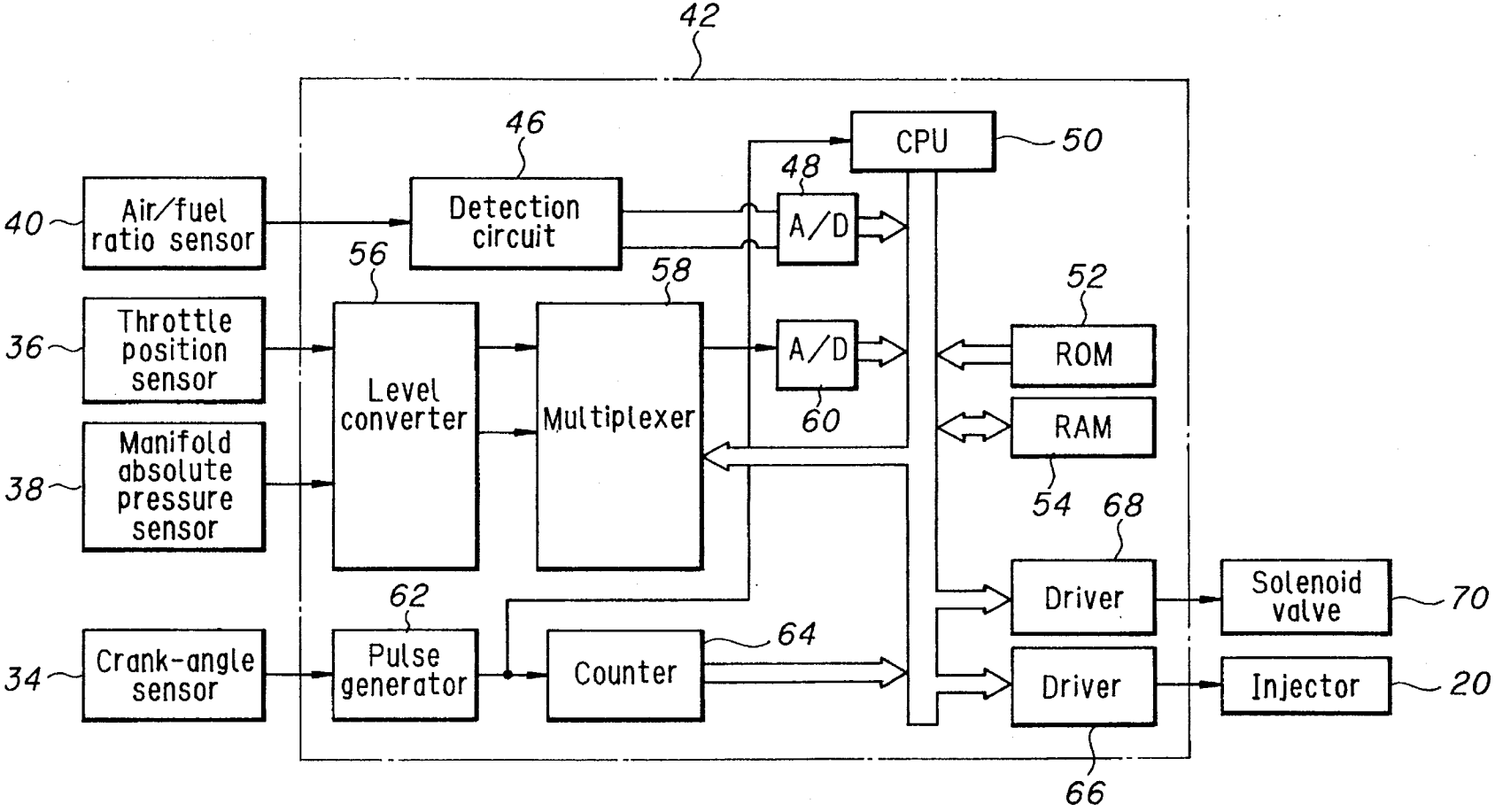
FIG. 2 is a block diagram showing the details of a control unit illustrated in FIG. 1.

Details of the control unit 42 are shown in the block diagram of FIG. 2. The output of the air/fuel ratio sensor 40 is received by a detection circuit 46 of the control unit 42, where it is subjected to appropriate linearization processing to obtain an air/fuel ratio (A/F) which is characterized by the fact that it varies linearly with the oxygen concentration of the exhaust gas over a broad range extending from lean to rich. As this air/fuel ratio sensor is explained in detail in the assignee's earlier Japanese Laid-Open Patent Publication No. Hei 4(1992)369,471; also as U.S. Pat. No. 5,391,282, it will not be explained further here. Hereinafter in this explanation, the air/fuel ratio sensor 40 will be referred to as the "LAF sensor" (the name is derived from its characteristics in which the air/fuel ratio can be detected linearly).

The output of the detection circuit 46 is forwarded through an A/D (analog/digital) converter 48 to a microcomputer which is comprised of a CPU (central processing unit) 50, a ROM (read-only memory) 52 and a RAM (random access memory) 54 and is stored in the RAM 54. Similarly, the analog outputs of the throttle position sensor 36 and the manifold absolute pressure sensor 38 are input to the microcomputer through a level converter 56, a multiplexer 58 and a second A/D converter 60, while the output of the crank-angle sensor 34 is shaped by a pulse generator 62 and has its output value counted by a counter 64; the result of the count is input to the microcomputer. In accordance with commands stored in the ROM 52, the CPU 50 of the microcomputer uses the detected values to compute an air/fuel ratio feedback control value, drives the injectors 20 of the respective cylinders via a driver 66 and drives a solenoid valve 70 via a second driver 68 for controlling the amount of secondary air passing through the bypass 28.

Explanation will next be made with reference to an air/fuel estimation at the individual cylinders from the output of the single air/fuel ratio sensor 40 installed at the exhaust system's confluence point (i.e., the exhaust pipe 24). Since, however, the estimation itself was described in the assignee's earlier application, and the gist of the present invention resides in how to realize such an air/fuel estimator on a low-performance, on-board microcomputer with a fewer-word-length, the explanation will be made in brief.

Figure 3:
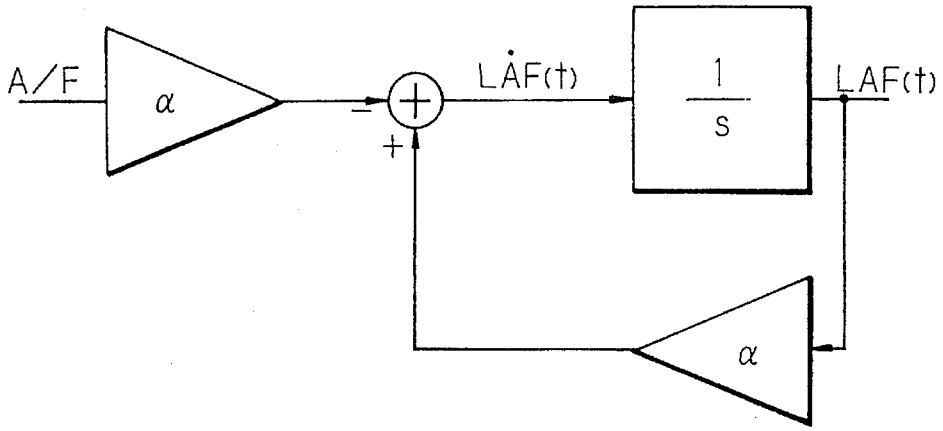
FIG. 3 is a block diagram showing a model describing the behavior of detection of an air/fuel ratio sensor illustrated in FIG. 2.

For high-accuracy separation and extraction of the air/fuel ratios of the individual cylinders from the output of the single LAF sensor 40, it is first necessary to accurately ascertain the detection response lag of the LAF sensor 40. This lag is assumed as a first-order lag and for this, a model shown in FIG. 3 is established. Here, if we define LAF: LAF sensor output and A/F: input air/fuel ratio, the state equation can be written as $$\dot{LAF}(t)=\alpha LAF(t)-\alpha A/F(t) \quad (1)$$

When the state equation is discretized in the discrete-time series for period delta T, we get $$LAF(k+1)=\hat{\alpha}LAF(k)+(1-\hat{\alpha})A/F(k) \quad (2)$$

Here:

$$\hat{\alpha}=1+\alpha\Delta T+(1/2!)\alpha^2\Delta T^2+(1/3!)\alpha^3\ \Delta T^3+(1/4!)\alpha^4\Delta T^4$$

Figure 4:
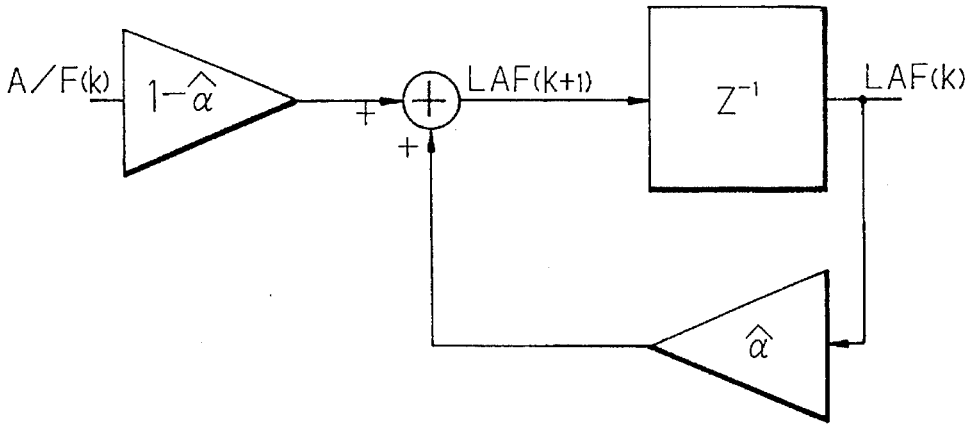
FIG. 4 is a block diagram showing the model of FIG. 3 discretized in the discrete-time series for period delta T.

Equation (2) is represented as a block diagram in FIG. 4.

Therefore, Equation (2) can be used to obtain the actual air/fuel ratio from the sensor output. That is to say, since Equation (2) can be rewritten as Equation (3), the value at time k−1 can be calculated back from the value at time k as shown by Equation (4).

$$A/F(k)=\{LAF(k+1)-\hat{\alpha}LAF(k)\}/(1-\hat{\alpha}) \quad (3)$$

$$A/F(k-1)=\{LAF(k)-\hat{\alpha}LAF(k-1)\}/(1-\hat{\alpha}) \quad (4)$$

Figure 5:
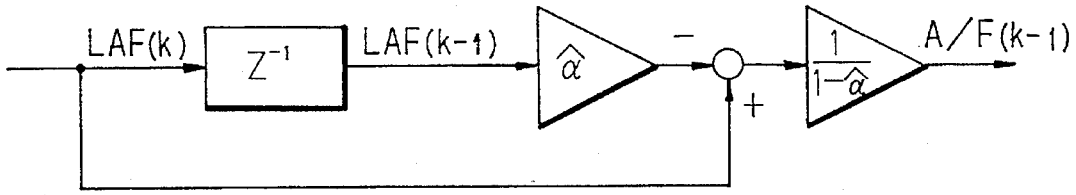
FIG. 5 is a block diagram showing a realtime estimator based on the model of FIG. 4.

Specifically, use of Z transformation to express Equation (2) in transfer function gives Equation (5), and a real-time estimate of the air/fuel ratio in the preceding cycle can be thus obtained by multiplying the sensor output LAF of the current cycle by its inverse transfer function. FIG. 5 is a block diagram of the real-time estimator.

$$t(z)=(1-\hat{\alpha})/(Z-\hat{\alpha}) \tag{5}$$

The separation and extraction of the air/fuel ratios of the individual cylinders using the air/fuel ratio estimated in the foregoing manner will now be explained.

As was mentioned in the earlier application, the air/fuel ratio at the confluence point of the exhaust system is assumed to be an average weighted to reflect the time-based contribution of the air/fuel ratios of the individual cylinders. This makes it possible to express the air/fuel ratio at the confluence point at time k in the manner of Equation (6). As F (fuel) was selected as the controlled variable in the exhaust gas model, the term fuel/air ratio F/A is used instead of the air/fuel ratio A/F in the figure. However, for ease of understanding, the word "air/fuel ratio" will still be used in the following except that the use of the word might cause confusion. Here, the #n in the equation indicates the cylinder number, and the firing order of the cylinders is defined as 1, 3, 4, 2. The air/fuel ratio here (correctly the fuel-air ratio (F/A)) is the estimated value obtained by correcting for the response lag.

$$\begin{aligned}
[F/A](k) &= C_1[F/A\#_1]+C_2[F/A\#_3]+ \\
&\quad C_3[F/A\#_4]+C_4[F/A\#_2] \\
[F/A](k+1) &= C_1[F/A\#_3]+C_2[F/A\#_4]+ \\
&\quad C_3[F/A\#_2]+C_4[F/A\#_1] \\
[F/A](k+2) &= C_1[F/A\#_4]+C_2[F/A\#_2]+ \\
&\quad C_3[F/A\#_1]+C_4[F/A\#_3] \\
&\quad \vdots
\end{aligned} \tag{6}$$

Figure 6:
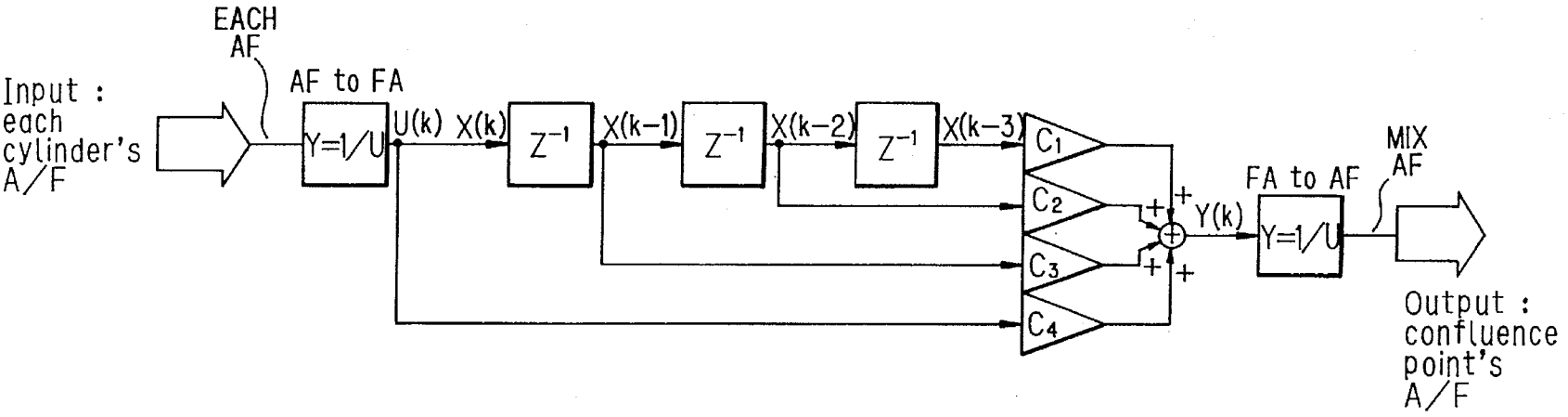
FIG. 6 is a block diagram showing a model named "exhaust gas model" describing the behavior of the exhaust system of the engine on which the air/fuel estimator according to the invention is based.

More specifically, the air/fuel ratio at the confluence point can be modeled as the sum of the products of the past firing histories of the respective cylinders and weights C (for example, 40% for the cylinder that fired most recently, 30% for the one before that, and so on). The model is shown in block diagram in FIG. 6 (hereinafter called the "exhaust gas model"). The state equation of the exhaust gas model can be written as $$\begin{pmatrix} x(k-2) \\ x(k-1) \\ x(k) \end{pmatrix} = \begin{pmatrix} 010 \\ 001 \\ 000 \end{pmatrix} \begin{pmatrix} x(k-3) \\ x(k-2) \\ x(k-1) \end{pmatrix} + \begin{pmatrix} 0 \\ 0 \\ 1 \end{pmatrix} u(k) \tag{7}$$

Further, if the air/fuel ratio at the confluence point is defined as y(k), the output equation can be written as $$y(k) = [C_1\ C_2\ C_3] \begin{pmatrix} x(k-3) \\ x(k-2) \\ x(k-1) \end{pmatrix} + C_4 u(k) \tag{8}$$

Here:

$C_1$: 0.25379, $C_2$: 0.10121, $C_3$: 0.46111$C_4$: 0.18389

Since u(k) in this equation cannot be observed, it will still not be possible, even if an observer is designed from the equation, to observe x(k). However, if one defines x(k+1)=x(k−3) on the assumption of a stable operating state in which there is no abrupt change in the air/fuel ratio from that 4 TDC earlier (i.e., from that of the same cylinder), Equation (9) will be obtained.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix} \tag{9}$$

$$y(k) = [C_1\ C_2\ C_3\ C_4] \begin{pmatrix} x(k-3) \\ x(k-2) \\ x(k-1) \\ x(k) \end{pmatrix}$$

Figure 7:
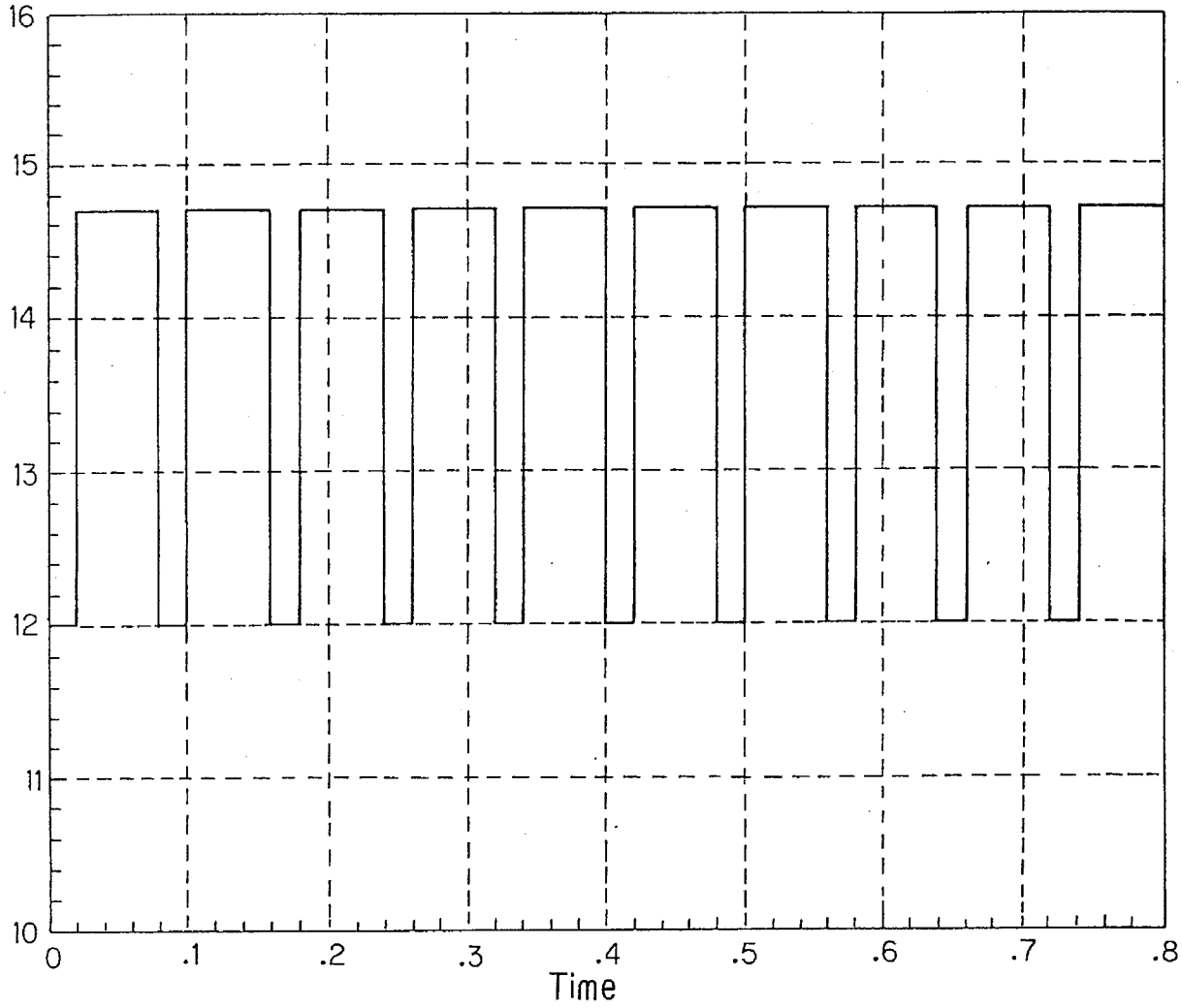
FIG. 7. is a view explaining a situation of a simulation using the model illustrated in FIG. 6 on the assumption that fuel is supplied to three cylinders of the four-cylinder engine so as to obtain an air/fuel ratio of 14.7:1 and to one cylinder so as to obtain an air/fuel ratio of 12.0:1.
Figure 8:
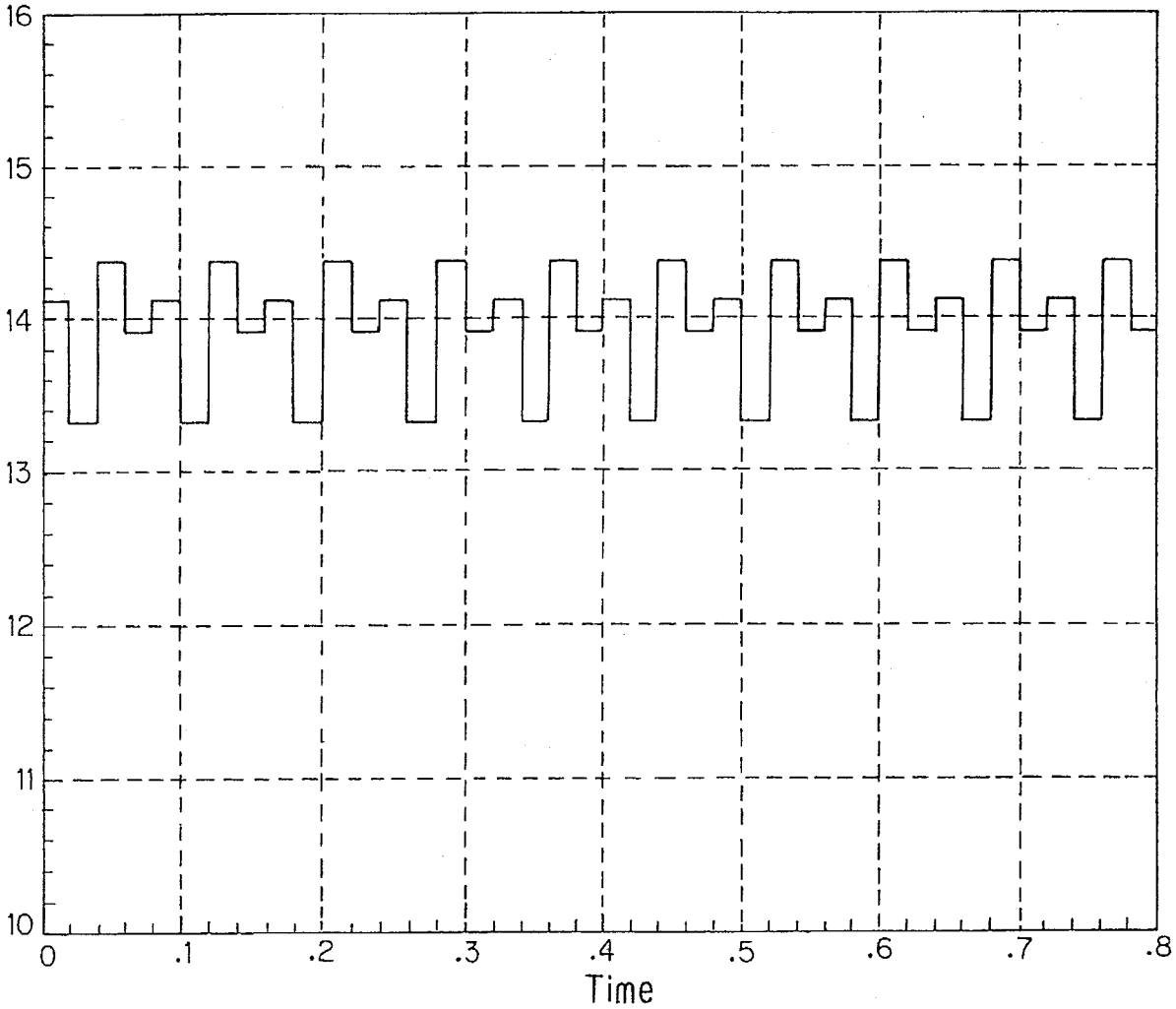
FIG. 8 is the result of the simulation showing the output of the exhaust gas. model indicative of the air/fuel ratio at a confluence point of the exhaust system of the engine when the fuel is supplied in the manner illustrated in FIG. 7.
Figure 9:
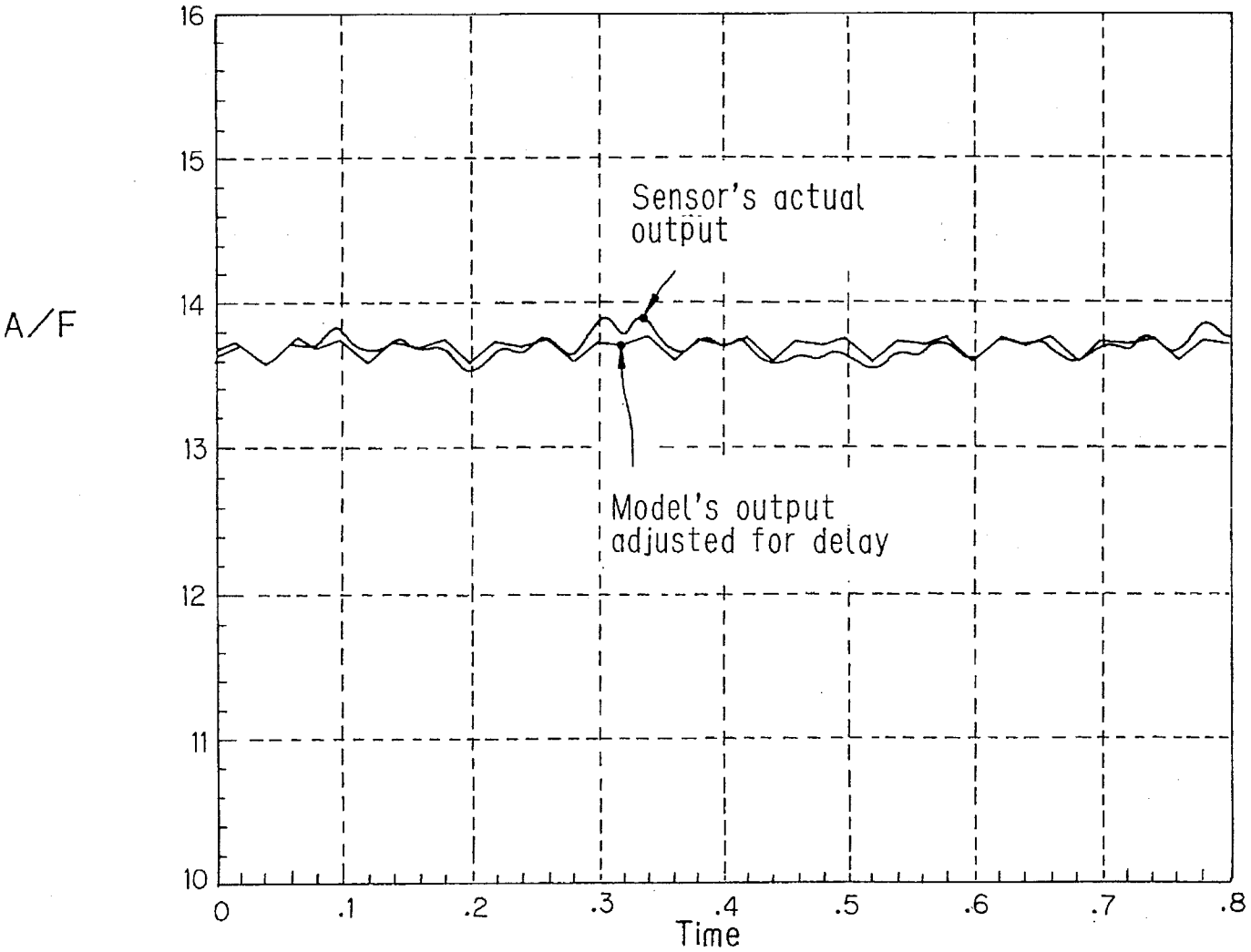
FIG. 9 is another result of the simulation showing the output of the exhaust gas model adjusted for sensor detection response delay in contrast with the sensor's actual output.

The simulation result for the exhaust gas model obtained in the foregoing manner will now be given. FIG. 7 shows a situation of the simulation in which fuel is supplied to three cylinders of the four-cylinder internal combustion engine so as to obtain an air/fuel ratio of 14.7:1 and to one cylinder so as to obtain an air/fuel ratio of 12.0:1. FIG. 8 is the result of the simulation showing the air/fuel ratio at this time at the confluence point as obtained using the aforesaid exhaust gas model. While FIG. 8 shows that a stepped output is obtained, when the aforesaid response delay of the LAF sensor is taken into consideration, the sensor output becomes the smoothed wave designated "Model's output adjusted for delay" in FIG. 9. The close agreement of the waveforms of the model's output and the sensor's actual output verifies the validity of the exhaust gas model as a model of the exhaust gas system of a multiple cylinder internal combustion engine.

Thus, the problem comes down to one of an ordinary Kalman filter in which X(k) is observed in the state equation and the output equation shown in Equation (10). When the weighting matrices Q, R are determined as Equation (11) and the Riccati's equation is solved, the gain matrix K becomes as shown in Equation (12).

$$\begin{cases} X(k+1) = AX(k) + Bu(k) \\ y(k) = CX(k) + Du(k) \end{cases} \tag{10}$$

Here:

$$A = \begin{pmatrix} 0100 \\ 0010 \\ 0001 \\ 1000 \end{pmatrix} C = [C_1C_2C_3C_4]\ B = D = [0]$$

$$X(k) = \begin{pmatrix} x(k-3) \\ x(k-2) \\ x(k-1) \\ x(k) \end{pmatrix}$$

$$Q = \begin{pmatrix} 1000 \\ 0100 \\ 0010 \\ 0001 \end{pmatrix} R = [1] \tag{11}$$

-continued $$K=\begin{pmatrix} -0.3093 \\ 1.1918 \\ 0.3093 \\ 0.0803 \end{pmatrix} \tag{12}$$

Obtaining A-KC from this gives Equation (13).

$$A-KC=\begin{pmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{pmatrix} \tag{13}$$

Figure 10:
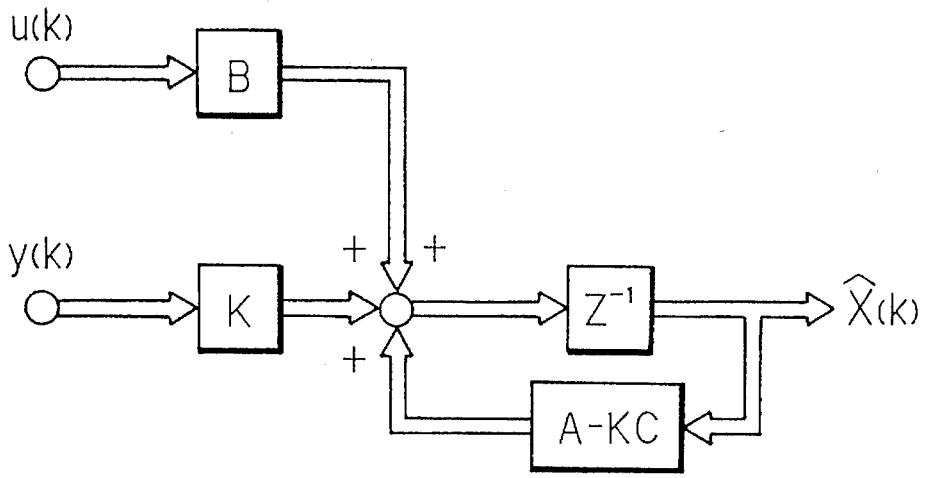
FIG. 10 is a block diagram showing the configuration of an ordinary observer.
Figure 11:
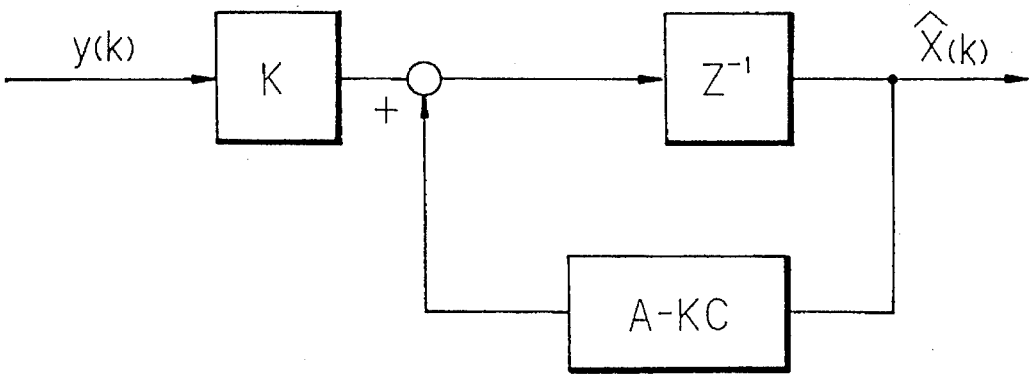
FIG. 11 is a block diagram showing the configuration of an observer used in the air/fuel estimator according to the present invention.

FIG. 10 shows the configuration of an ordinary observer. Since there is no input u(k) in the present model, however, the configuration has only y(k) as an input, as shown in FIG. 11. This is expressed mathematically by Equation (14) .

$$\begin{cases} \hat{X}(k+1)=[A-KC]\hat{X}(k)+y(k) \\ \hat{x}(k)=[0001]\hat{X}(k) \end{cases} \tag{14}$$

The system matrix S of the observer whose input is y(k), namely of the Kalman filter, is $$S=\begin{pmatrix} A-KC & K \\ 0001 & 0 \end{pmatrix} \tag{15}$$

In the present model, when the ratio of the member of the weight imputation R in the Riccati's equation to the member of Q is 1:1, the system matrix S of the Kalman filter is given as $$S=\begin{pmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 0.0 & 0.0 \end{pmatrix} \tag{16}$$

Figure 12:
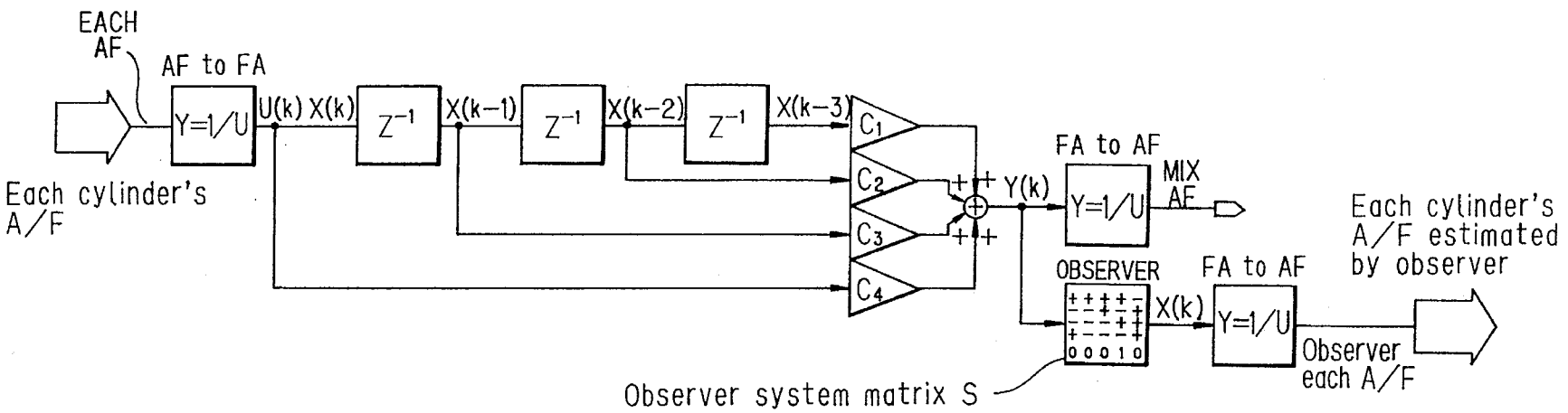
FIG. 12 is a block diagram showing the basic configuration of the air/fuel ratio estimator according to the invention.

FIG. 12 shows the air/fuel ratio estimator thus obtained.

Returning to Equation 10, consideration will be given to the range of change of the state variable X(k) i.e., the range that the value F/A can possibly change. Since the air/fuel ratio A/F will range from 10 through 30 at most, the fuel/air ratio F/A will therefore be 1/30 through 1/10. The resolving power of the value can accordingly be determined in accordance therewith. In the following, the ratio A/F is used, instead of the ratio F/A, for ease of understanding.

Figure 13:
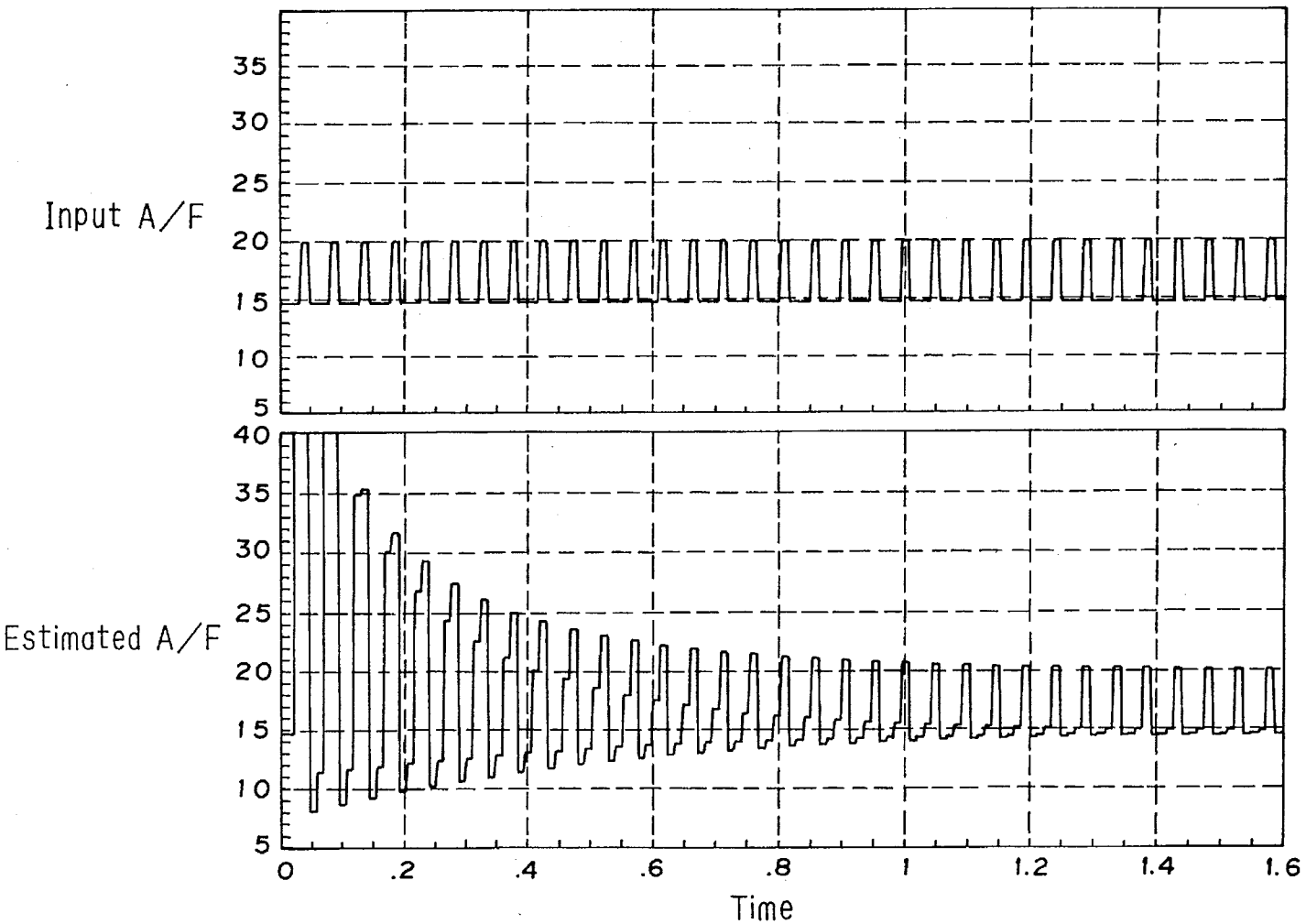
FIG. 13 is the result of a simulation showing estimation of the observer illustrated in FIG. 12.

However, as illustrated in FIG. 13 which shows a simulation result of the observer's estimation, the value A/F temporarily becomes greater than the range in the course of estimation, although the value A/F falls finally within the range. This is not a serious problem in a laboratory, but makes it difficult to implement this on a low-performance, on-board microcomputer.

Figure 14:
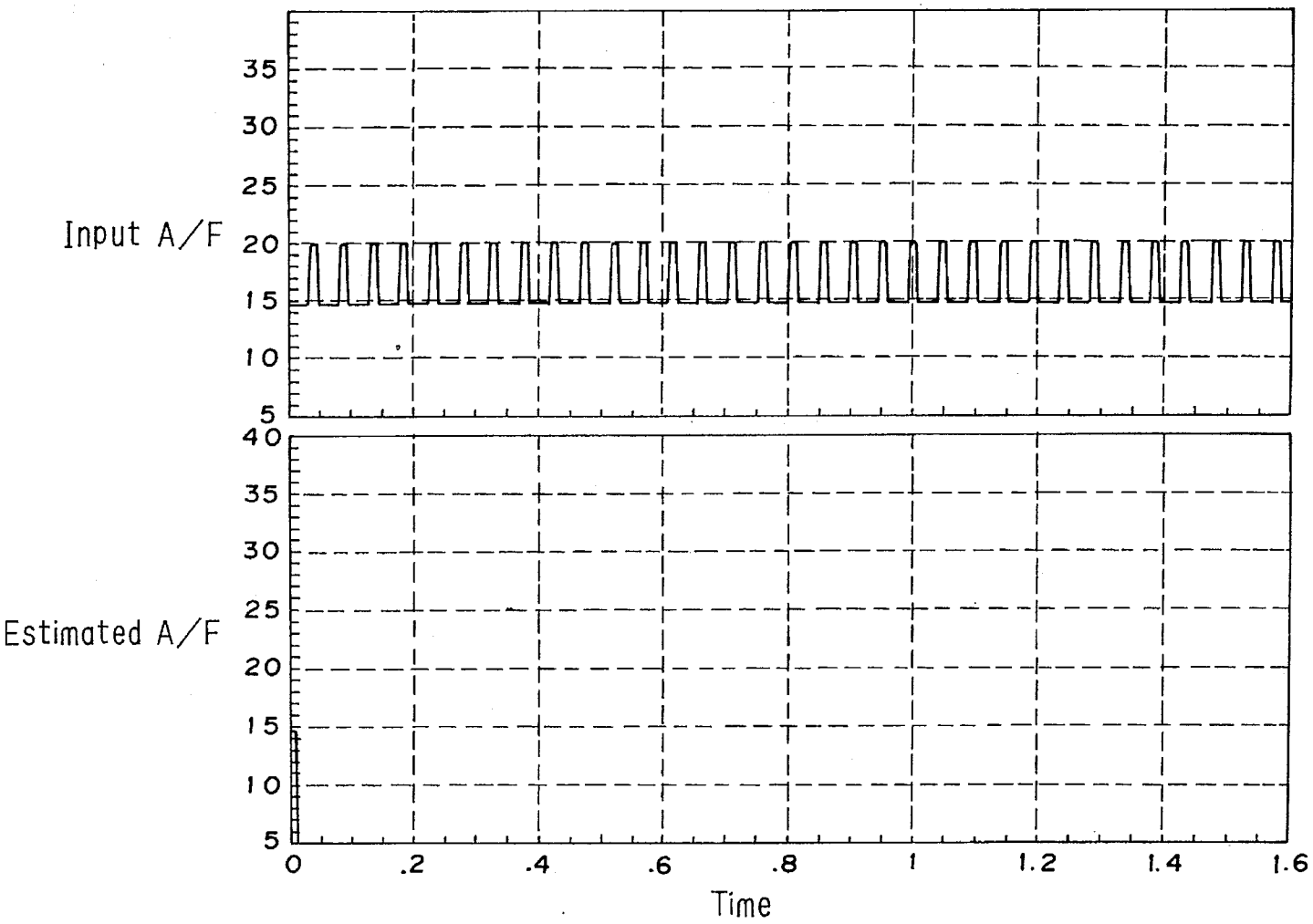
FIG. 14 is a view similar to FIG. 13 but showing the result of a simulation demonstrating a first embodiment of the invention in which the observer is configured such that the estimated value is restricted to a limit if it exceeds the limit.

In one embodiment of the present invention, therefore, treating the aforesaid range 10 through 30 as lower and upper limits, the observer's estimation is simulated in such a manner that if the value A/F exceeds the upper or lower limit, the value A/F is forcibly limited to or replaced with the limit. FIG. 14 demonstrates the result of the simulation. In the embodiment, however, the estimated value A/F diverges, rather than converges, rendering proper air/fuel estimation impossible. The reason for this may probably be that, since it is the same as adding such a limiter in the configuration of Equation 14, the system loses linearity.

Figure 15:
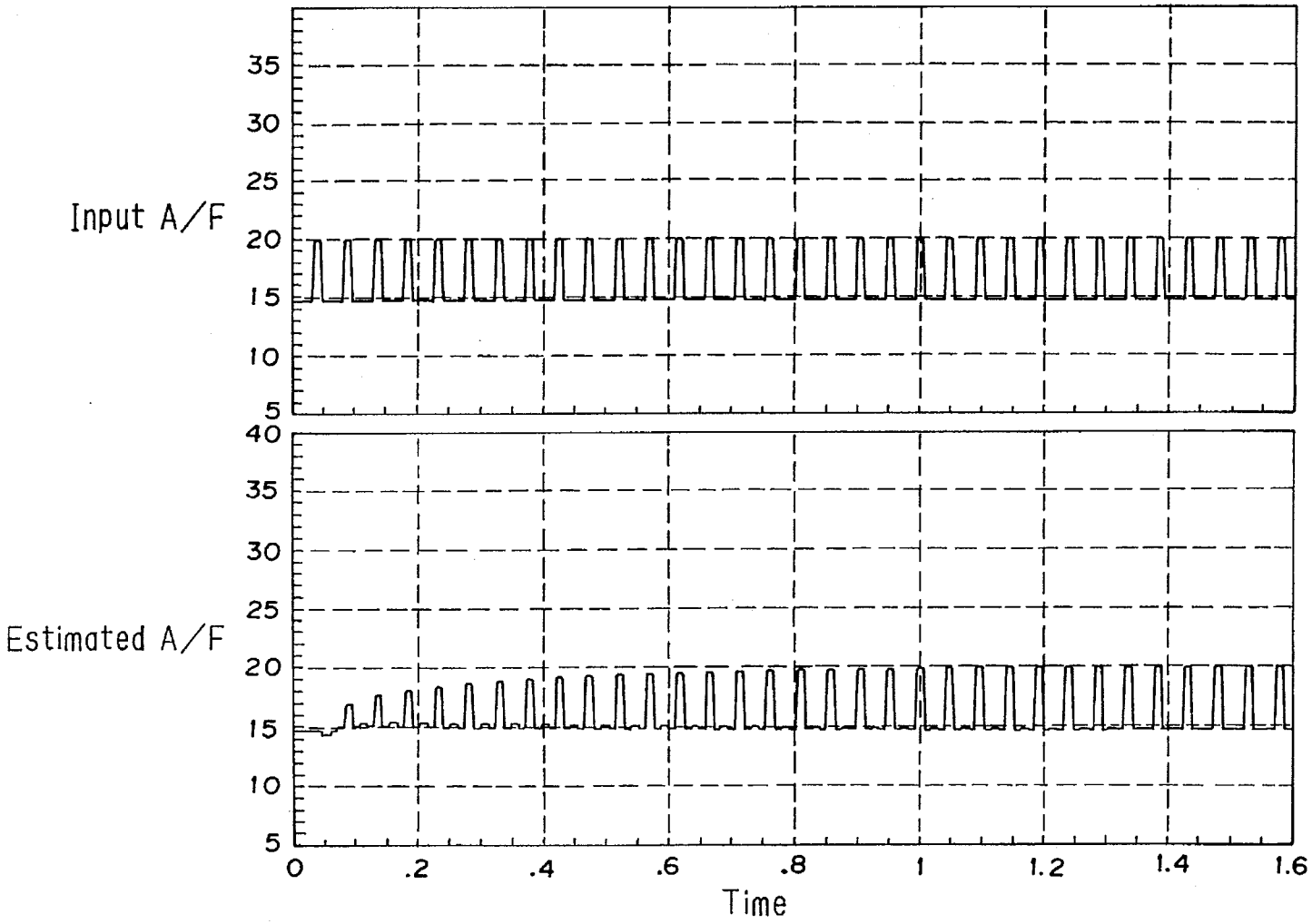
FIG. 15 is a view similar to FIG. 13 but showing the result of a simulation demonstrating a second embodiment of the invention in which the observer is configured such that the estimated value is returned to an initial value if it exceeds the limit.

Then, the observer is configured such that the value A/F is forcibly returned to a predetermined value (i.e., its initial value (=14.7) in the embodiment) when it exceeds the upper or the lower limit, and a simulation is conducted. FIG. 15 shows the result of the simulation. In this embodiment, the estimated value does not exceed either of the limits and converges to the input A/F. Although it is considered, prior to the simulation, that theoretically it takes some time until the value has converged to the input, the time of convergence is less than expected. At any rate, it will be apparent from the simulation result that no divergence occurs as long as the system is stable.

In this embodiment, since it is arranged such that the upper and lower limits are set for the state variable and when the state variable exceeds either limit, the state variable is forcibly replaced with the predetermined value (the initial value), it becomes possible to narrow the range of the change of the state variable and to sufficiently ensure the resolving power required. Thus, since the configuration does not need a large-word-length computer, it becomes possible to realize the estimator on a low-performance, on-board microcomputer with small-word-length. In other words, by providing only one air/fuel ratio sensor at the exhaust confluence point of a multicylinder internal combustion engine, it becomes possible to accurately estimate the air/fuel ratios at the individual cylinders from the output of the sensor, and to control the air/fuel ratios to a desired air/fuel ratio(s). Although the calculation for convergence is started again when the state variable is forcibly returned to the initial value and it takes some time until it has converged, no divergence occur as long as the system is maintained stable.

It should be noted that, although the state variable is returned to the initial value in the embodiment, it is alternatively possible to return the state variable to an appropriate value other than the initial value.

It should further be noted that, although the invention has been described taking as an example the air/fuel ratio estimator, it is alternatively possible to apply it to any other estimator or controller having a similar configuration.

The present invention has thus been shown and described with reference to the specific embodiments. However, it should be noted that the present invention is in no way limited to the details of the described arrangements; changes and modifications may be made without departing from the scope of the appended claims.

What is claimed is:

1. An air/fuel ratio estimator for estimating an air/fuel ratio of a mixture supplied to each cylinder of a multicylinder internal combustion engine through an output of an air/fuel ratio sensor installed at a confluence point of an exhaust system of said engine, comprising:

estimating means for modeling said exhaust system by at least one state equation having a state variable indicative of said air/fuel ratio to estimate said air/fuel ratio of each cylinder of said engine, said estimating means includes a control means for controlling said air/fuel ratio at each cylinder to a desired value based on said estimated air/fuel ratio; and a limiting means for establishing a limit for said state variable such that said state variable is replaced with a value if said state variable exceeds said limit.

2. An air/fuel ratio estimator according to claim 1, wherein said limiting means establishes upper and lower limits, and said state variable is replaced with said value within said limits if said variable exceeds either of said limits.

3. An air/fuel ratio estimator according claim 1, wherein said value is a predetermined value.

4. An air/fuel ratio estimator according claim 3, wherein said predetermined value is an initial value of said variable.

5. An air/fuel ratio estimator according claim 2, wherein said value is a predetermined value.

6. An air/fuel ratio estimator according claim 5, wherein said predetermined value is an initial value of said variable.

7. An air/fuel ratio estimator for estimating an air/fuel ratio of a mixture supplied to each cylinder of a multicylinder internal combustion engine through an output of an air/fuel ratio sensor installed at a confluence point of an exhaust system of said engine, comprising:

first means for assuming said output of said air/fuel ratio sensor as an average value made up of a sum of products of past firing histories of each cylinder weighted by a predetermined value, and establishing a model using said air/fuel ratio as a state variable;

second means for obtaining a state equation with respect to said state variable;

an observer that observes said state variable; and third means for estimating said air/fuel ratio at each cylinder from an output of said observer, said third means includes control means for controlling said air/fuel ratio at each cylinder to a desired value based on said estimated air/fuel ratio; and fourth means for establishing a limit for said state variable such that said state variable is replaced with a value if said state variable exceeds said limit.

8. An air/fuel ratio estimator according to claim 7, wherein said fourth means establishes upper and lower limits, and said state variable is replaced with said value within said limits if said variable exceeds either of said limits.

9. An air/fuel ratio estimator according claim 7, wherein said value is a predetermined value.

10. An air/fuel ratio estimator according claim 9, wherein said predetermined value is an initial value of said variable.

11. An air/fuel ratio estimator according claim 8, wherein said value is a predetermined value.

12. An air/fuel ratio estimator according claim 11, wherein said predetermined value is an initial value of said variable.

* * * * *